US010648656B2

(12) United States Patent
Li et al.

(10) Patent No.: US 10,648,656 B2
(45) Date of Patent: May 12, 2020

(54) FLOODLIGHT

(71) Applicant: LEDLUCKY Holdings Company Ltd., Shenzhen, Guangdong (CN)

(72) Inventors: Guoxin Li, Guangdong (CN); Shaoqing Luo, Guangdong (CN); Rong Luo, Guangdong (CN); Houbin Huang, Guangdong (CN)

(73) Assignee: LEDLUCKY Holdings Company Ltd., Shenzhen (CN)

( * ) Notice: Subject to any disclaimer, the term of this patent is extended or adjusted under 35 U.S.C. 154(b) by 0 days.

(21) Appl. No.: 16/468,480

(22) PCT Filed: Oct. 11, 2017

(86) PCT No.: PCT/CN2017/105720
§ 371 (c)(1),
(2) Date: Jun. 11, 2019

(87) PCT Pub. No.: WO2019/010852
PCT Pub. Date: Jan. 17, 2019

(65) Prior Publication Data

US 2020/0072454 A1 Mar. 5, 2020

(30) Foreign Application Priority Data

Jul. 10, 2017 (CN) ..... 2017 1 0558356

(51) Int. Cl.
*F21V 21/00* (2006.01)
*F21V 29/76* (2015.01)
(Continued)

(52) U.S. Cl.
CPC ..... *F21V 29/763* (2015.01); *F21V 21/30* (2013.01); *F21Y 2115/10* (2016.08)

(58) Field of Classification Search
CPC ..... F21V 29/703; F21V 21/30; F21Y 2115/10
(Continued)

(56) References Cited

U.S. PATENT DOCUMENTS 5,504,665 A * 4/1996 Osteen ..... F21V 21/26 362/269
9,651,227 B2 * 5/2017 Pickard ..... F21V 13/04

FOREIGN PATENT DOCUMENTS

CN 203979911 U 12/2014
CN 105240809 A 1/2016
(Continued)

OTHER PUBLICATIONS

International Search Report and Written Opinion dated Apr. 13, 2018 for corresponding international application No. PCT/CN2017/105720.

*Primary Examiner* — Ali Alavi
(74) *Attorney, Agent, or Firm* — Westman, Champlin & Koehler, P.A.

(57) ABSTRACT

The present invention provides a floodlight, including a mounting rack, a power source module, a rotating assembly, buckling covers, several heat dissipation components, and an LED module, where the rotating assembly includes a connecting pipe and rotating seats; the heat dissipation component includes a heat dissipation body and a gear cover; an abutment surface is disposed on a top surface of the rotating seat; a pin-jointed surface is disposed on a bottom surface of the buckling cover; and two ends of the mounting rack are respectively clamped to rotating seats and then are pin-jointed to the buckling covers, to adjust an irradiation angle of the floodlight. The foregoing floodlight has a simple structure, a small size, and an adjustable irradiation angle. The connecting pipe is connected to the heat dissipation body and the gear cover to implement modular assembly of the multiple heat dissipation compo-
(Continued)

nents, so that an overall size of the heat dissipation components is small; an annular clamping tooth paired with the rotating seat is disposed on the gear cover, for fixed installation of the mounting rack, so that it is very convenient for site operation personnel to adjust an angle of the floodlight; and there are multiple installation directions on the mounting rack, to satisfy installation requirements of the floodlight in a variety of occasions, thereby making the floodlight have relatively high practicability.

20 Claims, 9 Drawing Sheets

(51) Int. Cl.
*F21V 21/30* (2006.01)
*F21Y 115/10* (2016.01)

(58) Field of Classification Search
USPC ..... 362/373
See application file for complete search history.

(56) References Cited

FOREIGN PATENT DOCUMENTS

| | | | |
|---|---|---|---|
| CN | 106704951 | A | 5/2017 |
| KR | 2016132505 | A | 11/2016 |

* cited by examiner

FLOODLIGHT

CROSS REFERENCE

This application claims priority to Chinese Patent Application No. 201710558356.0, filed with the Chinese Patent Office on Jul. 10, 2017 and entitled "FLOODLIGHT", which is incorporated herein by reference in its entirety.

TECHNICAL FIELD

The present invention relates to the field of lighting technologies, and in particular, to a floodlight with a small size, convenient installation, low energy consumption, and a modular structure.

BACKGROUND

In open and busy places such as a square, a stadium, a leisure area, and a parking lot of a city, a floodlight is usually installed to implement concentrated illumination in a wide range, especially a stadium lamp. With professionalism of various sport events and popularity of sports, people have an increasing requirement on a stadium lamp.

In a conventional technology, a floodlight includes a lamp post and a lamp installed on the lamp post, where the lamp is fixedly installed on a top end of the lamp post; an irradiation angle of the lamp is fixed. Because the lamp and the lamp post are fixedly connected, the irradiation angle of the lamp cannot be changed. In different places, an illuminate angle range of a floodlight cannot be adjusted according to a site need; a structure of the whole lamp is complex; and there are various assembly working procedures. In addition, a light source of the floodlight is mainly a high-pressure sodium lamp, a high-pressure mercury lamp, and a metal halide lamp; there is a large amount of mercury vapor in the light source, and if the light source is broken, the mercury vapor is volatilized into the atmosphere; the light source further contains mercury, lead, arsenic and other elements that cause serious pollution to an environment, which also brings harm to human health. Furthermore, because photoelectric conversion efficiency of the floodlight is low, a large amount of heat energy is generated, and conversely, generated light is little, and the lamp body has a relatively large size and is unaesthetic in appearance.

SUMMARY

An objective of the present invention is to provide a floodlight, which has advantages of simple structure, modular assembly, easy installation, small size, long service life, large illumination range, adjustable irradiation angle, and high effective lighting efficiency, so that the floodlight can meet requirements in different occasions.

To achieve the above objective, the present invention provides the following technical solutions.

A floodlight includes a mounting rack, a power source module installed on the mounting rack, a rotating assembly connected to the mounting rack, two buckling covers that cooperate with two sides of the rotating assembly that are opposite to each other, several heat dissipation components installed on the rotating assembly, and an LED module located inside the heat dissipation component, where the rotating assembly includes a connecting pipe and rotating seats located at two end portions of the connecting pipe; the heat dissipation component includes a heat dissipation body and a gear cover installed on the heat dissipation body; a clamping cavity is enclosed by a top surface of the heat dissipation body and the gear cover, for accommodating the connecting pipe; an abutment surface is disposed on a top surface of the rotating seat; a pin-jointed surface pin-jointed to the abutment surface corresponding to the rotating seat is disposed on a bottom surface of the buckling cover; and two ends of the mounting rack are respectively clamped to corresponding rotating seats and then are pin-jointed to the corresponding buckling covers, to adjust an irradiation angle of the floodlight.

The foregoing floodlight has a simple structure, modular assembly, easy installation, a small size, long service life, a large illumination range, an adjustable irradiation angle. A connecting pipe is connected to a heat dissipation body and a gear cover to implement modular assembly of multiple heat dissipation components, so that an overall size of the heat dissipation components is small; an annular clamping tooth paired with a rotating seat is disposed on the gear cover, for fixed installation of a mounting rack, so that it is very convenient for site operation personnel to adjust an angle of the floodlight; and there are multiple installation directions on the mounting rack, to satisfy installation requirements of the floodlight in a variety of occasions, thereby making the floodlight have relatively high practicability.

In an embodiment, the rotating seat includes a seat body, a central pillar located on a central part of the seat body, and several annular abutment teeth disposed on an outer wall of the seat body; and the annular abutment tooth forms a stepped groove with the seat body, so that the annular abutment tooth protrudes outward from the stepped groove.

In an embodiment, an abutment tooth groove is formed between adjacent annular abutment teeth, and an included angle formed between the adjacent annular abutment teeth and a center axis of the central pillar is an acute angle.

In an embodiment, the rotating seat further includes an indicator panel located an end portion of the annular abutment tooth; several scale marks are disposed on an outer surface of the indicator panel; the scale mark is opposite to the annular abutment tooth; and the scale marks form a scale mark group that is annularly distributed around the center axis of the central pillar.

In an embodiment, the buckling cover includes a cover body and an annular clamping tooth extending along an axial direction of the cover body; the annular clamping tooth is abutted with the abutment tooth groove; the annular clamping teeth are evenly arranged, and a clamping tooth groove is formed between adjacent annular clamping teeth; and the clamping tooth groove is abutted with the annular abutment tooth.

In an embodiment, the annular clamping tooth protrudes outward from an end surface of the cover body; a guide groove is disposed in the annular clamping tooth; and an inner wall of the guide groove forms an inclined guide surface extending outward.

In an embodiment, the rotating assembly further includes several fixing pieces installed below the connecting pipe; the connecting pipe is provided with an accommodating groove and a clamping groove that are recessed and extend inward from an outer wall of the connecting pipe; the fixing pieces are accommodated in the accommodating groove; the fixing piece is provided with a clamping column that protrudes and extends outward from an upper surface of the fixing piece and several fixing teeth that protrude and extend outward from a lower surface of the fixing piece; and the clamping column is clamped with the clamping groove, so that the fixing piece is clamped with the connecting pipe.

In an embodiment, a first mounting groove and a second mounting groove, and a third mounting groove are disposed on the heat dissipation body; the second mounting groove is located between the first mounting groove and the third mounting groove; and the second mounting groove is provided with several clamping teeth that are clamped together with the fixing teeth corresponding to the fixing pieces; and the heat dissipation body is clamped with the connecting pipe through the fixing piece.

In an embodiment, one end of the gear cover is fastened to the first mounting groove through a bolt, and the other end of the gear cover is pin-jointed in the third mounting groove through a fixing shaft, so that the gear cover rotates up and down relative to the heat dissipation body.

A floodlight includes a mounting rack, a power source module installed on the mounting rack, a rotating assembly connected to the mounting rack, two buckling covers that cooperate with two sides of the rotating assembly that are opposite to each other, several heat dissipation components installed on the rotating assembly, and an LED module located inside the heat dissipation component, where the rotating assembly includes a connecting pipe and rotating seats located at two end portions of the connecting pipe; the heat dissipation component includes a heat dissipation body and a gear cover installed on the heat dissipation body; a clamping cavity is enclosed by a top surface of the heat dissipation body and the gear cover, for accommodating the connecting pipe; several annular abutment teeth are disposed on an outer wall of the rotating seat; an annular clamping tooth engaged with an annular abutment tooth corresponding to the rotating seat is disposed on a bottom surface of the buckling cover; and two ends of the mounting rack are respectively clamped to corresponding rotating seats and then are pin-jointed to the corresponding buckling covers, to adjust an irradiation angle of the floodlight.

BRIEF DESCRIPTION OF THE DRAWINGS

The present invention will be explained in detail with reference to the accompanying drawings.

DETAILED DESCRIPTION

Figure 1:
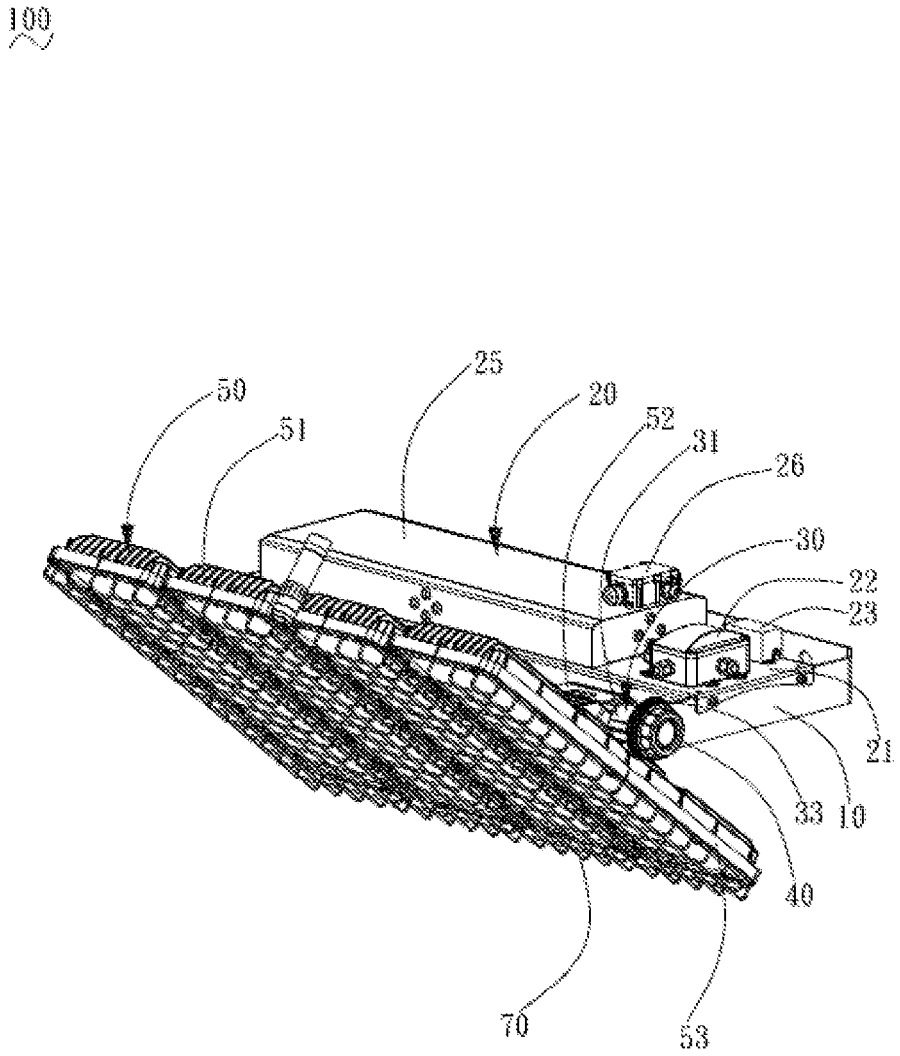
FIG. 1 is a three-dimensional schematic diagram of a floodlight according to a preferred embodiment of the present invention.
Figure 2:
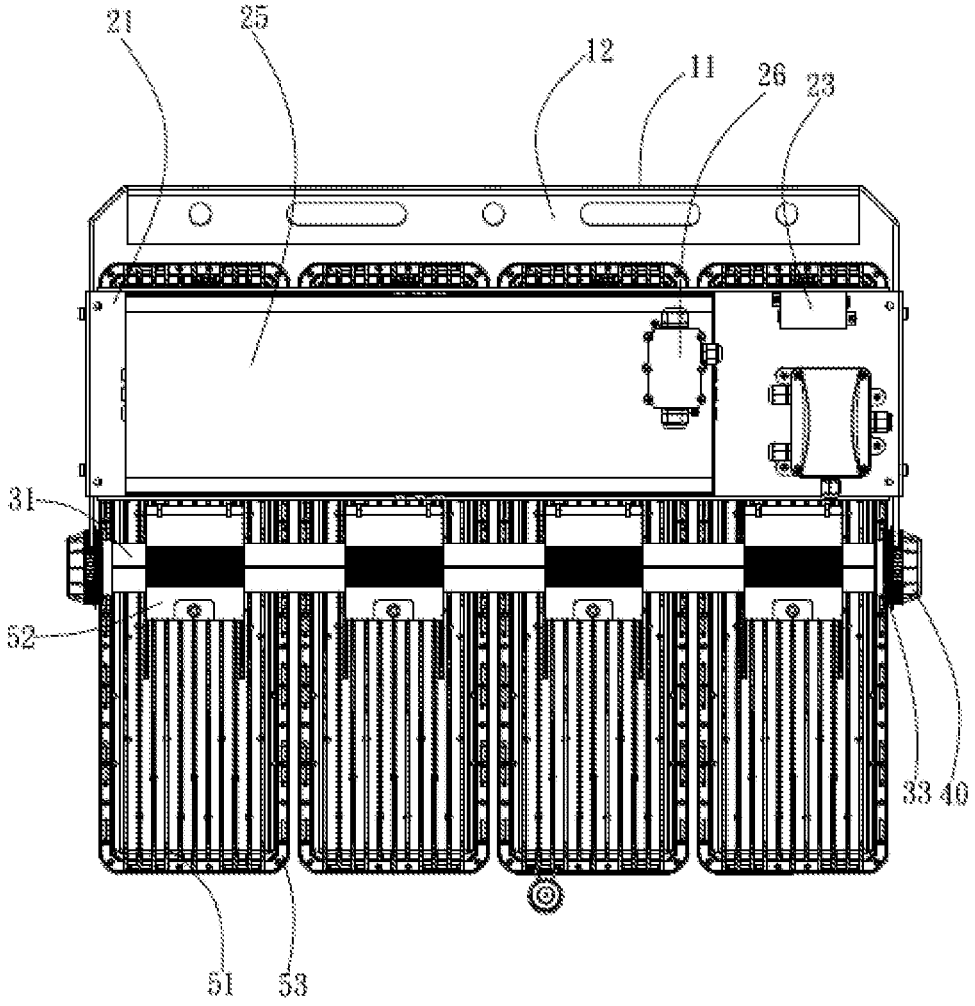
FIG. 2 is a top view of the floodlight shown in FIG. 1.

For ease of understanding the present invention, the following describes the present invention more comprehensively with reference to relevant accompanying drawings. Preferred embodiments of the present invention are provided in the accompanying drawings. However, the present invention may be implemented in many different forms and is not limited to the embodiments described in the specification. On the contrary, an objective of providing these embodiments is to provide a more thorough and comprehensive understanding of content disclosed in the present invention.

It should be noted that when an element is referred to as "fixed to" another element, it may be directly on the another element or there may exist an intermediate element. When an element is referred to as "connected to" another element, it may be directly connected to the another element or there may exist an intermediate element.

Unless otherwise specified, meanings of all technical and scientific terms used in this specification are the same as that usually understood by persons skilled in the art belonging to the present invention. Terms used in this specification of the present invention are only used to describe specific embodiments, but are not intended to limit the present invention.

Referring to FIG. 1 to FIG. 9, a floodlight 100 in a preferred embodiment of the present invention is provided, and is used for illumination in places such as a square, a stadium, a leisure area, and a parking lot of a city, for example, a stadium lamp. The floodlight 100 includes a mounting rack 10, a power source module 20 installed on the mounting rack 10, a rotating assembly 30 connected to the mounting rack 10, two buckling covers 40 that cooperate with two sides of the rotating assembly 30 that are opposite to each other, several heat dissipation components 50 installed on the rotating assembly 30, an LED module 60 located inside the heat dissipation component 50, and a protective cover 70 installed below the heat dissipation component 50. The mounting rack 10 is connected to the rotating assembly 30 and the buckling cover 40, so that the heat dissipation component 50 rotates relative to the mounting rack 10.

The mounting rack 10 is configured to support the whole device. The mounting rack 10 includes a first installation part 11 and a second installation part 12, where several first installation ports are disposed on the first installation part 11, and the first installation ports are evenly arranged; several second installation ports are disposed on the second installation part 12, and the second installation ports are evenly arranged; and both the first installation port and the second installation port are used to fasten the mounting rack 10, so that the mounting rack 10 can be installed in multiple directions. In this embodiment, an included angle formed by the first installation part 11 and the second installation part 12 is a right angle. It can also be understood that, the included angle formed by the first installation part 11 and the second installation part 12 may be an acute angle or an obtuse angle, as long as the mounting rack 10 can support a weight of the heat dissipation component 50 when being installed. A rotating hole 13 and an indication hole 14 are disposed on two end portions of the mounting rack 10, and the indication hole 14 is located on a rear end portion of the rotating hole 13 and disposed in parallel with the rotating hole 13.

Figure 3:
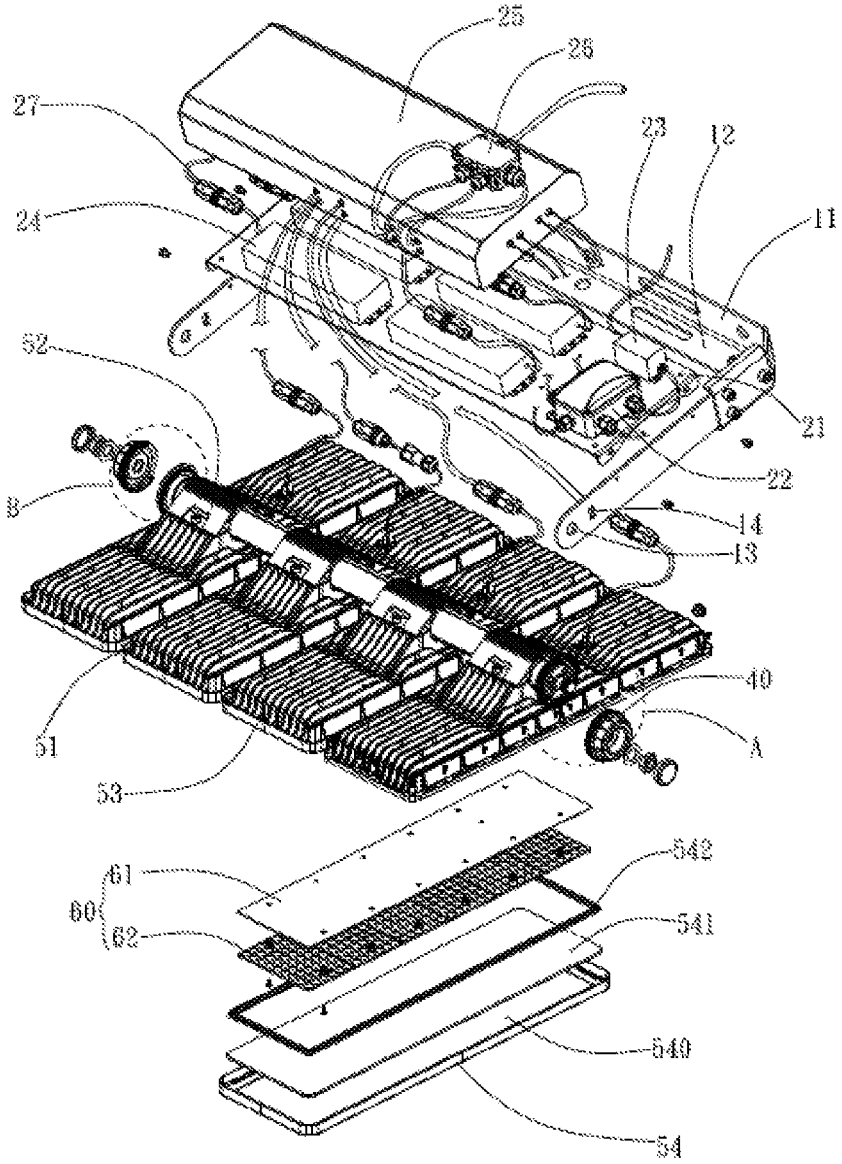
FIG. 3 is an exploded view of the floodlight shown in FIG. 2.

Referring to FIG. 3, the power source module 20 is configured to provide power for the whole device. The power source module 20 includes a base plate 21 installed on the mounting rack 10, a first junction box 22 fastened to the base plate 21, a lightning arrester 23, several dimming power sources 24, a power box 25 covering the dimming power source 24, a second junction box 26 fastened above the power box 25, and several waterproof connectors 27. An input end of the dimming power source 24 is connected to both the first junction box 22 and the second junction box 26 through the waterproof connector 27. An output end of each dimming power source 24 is electrically connected to a corresponding LED module 60 through the waterproof connector 27. The first junction box 22 is configured to connect an external power source, and the second junction box 26 is electrically connected to the first junction box 22 through the lightning arrester 23, to avoid impact on the device during thundering.

Figure 4:
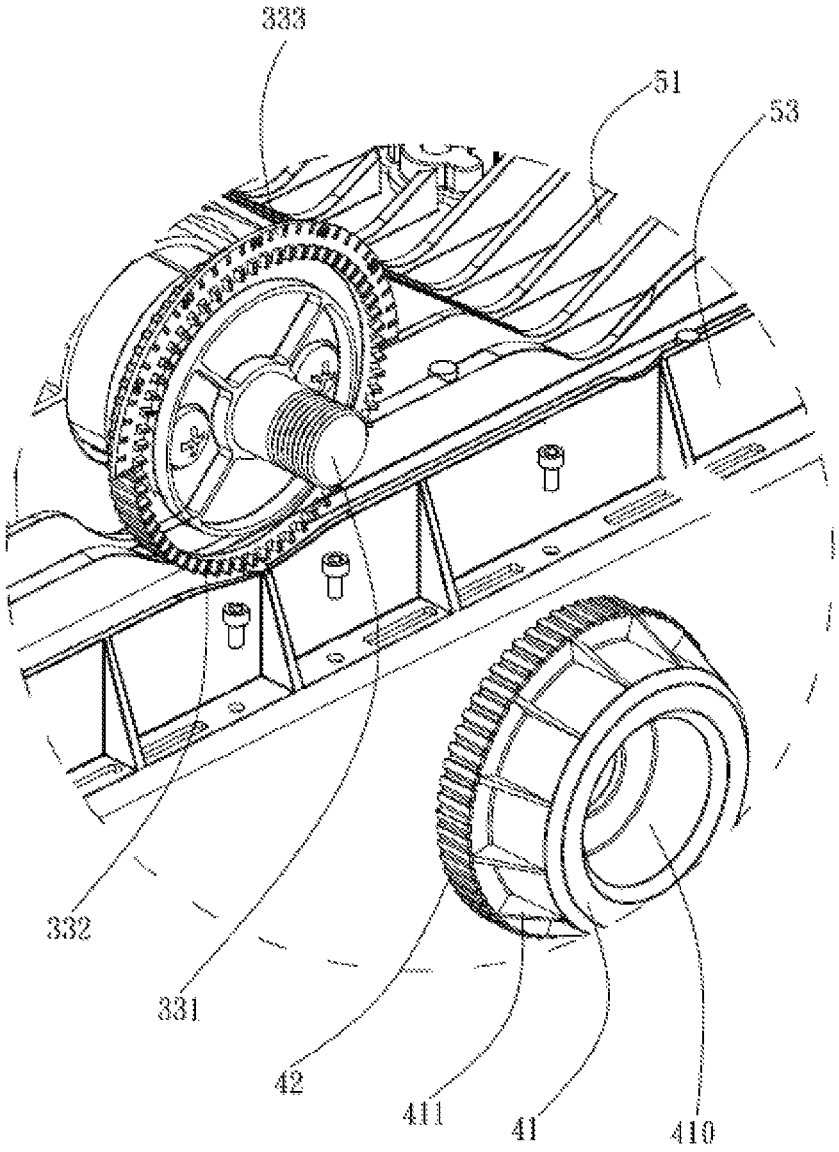
FIG. 4 is an enlarged view of a position A shown in FIG. 3.
Figure 5:
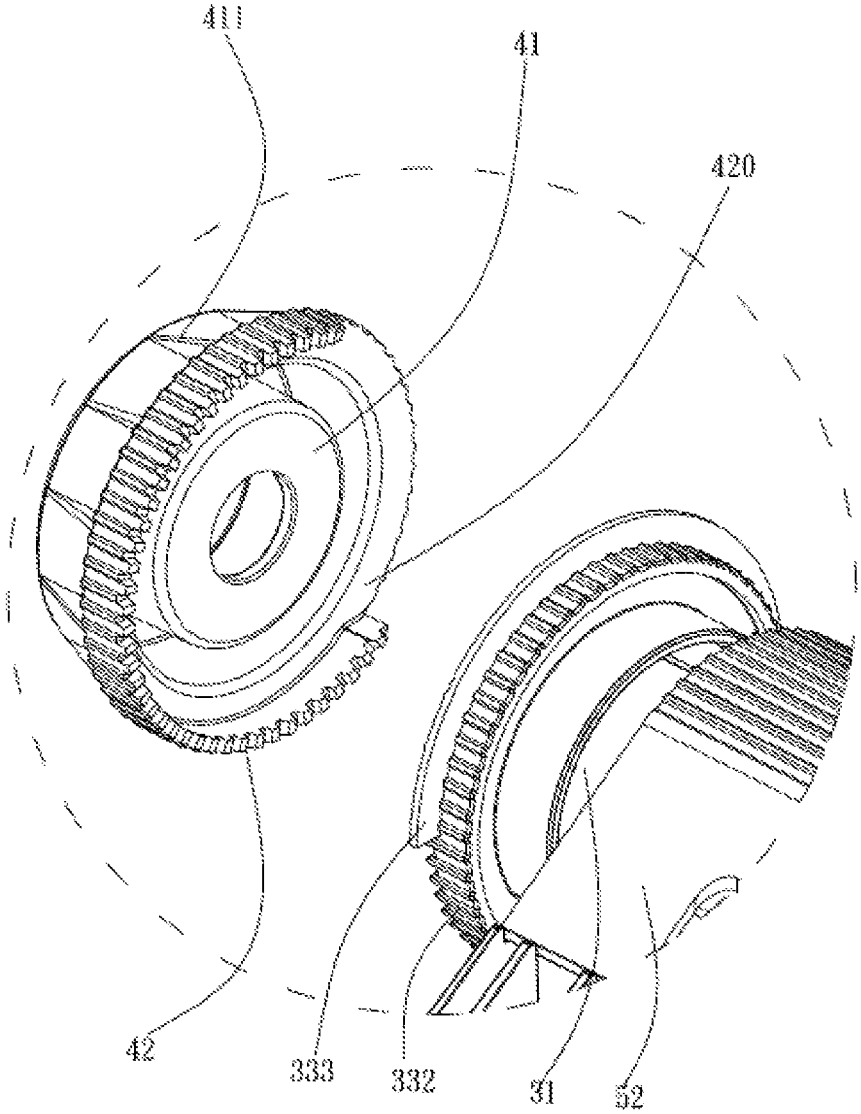
FIG. 5 is an enlarged view of a position B shown in FIG. 3.
Figure 6:
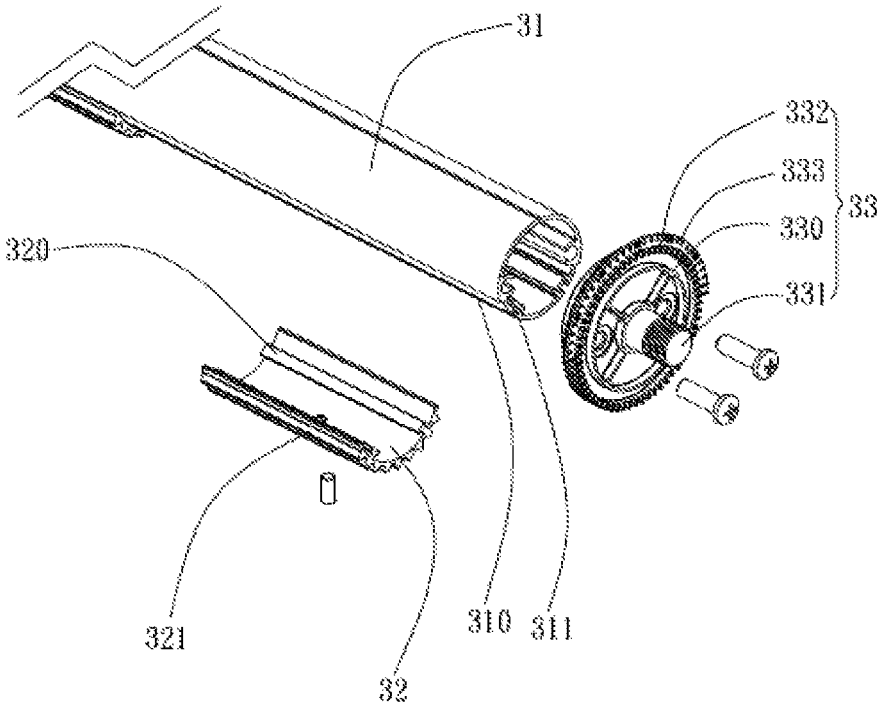
FIG. 6 is an exploded view of a rotating assembly shown in FIG. 3.

Referring to FIG. 4 to FIG. 6, the rotating assembly 30 is configured to connect to the mounting rack 10 and the heat dissipation component 50. The rotating assembly 30 includes a hollow connecting pipe 31, several fixing pieces 32 installed below the connecting pipe 31, and rotating seats 33 located on two end portions of the connecting pipe 31. The connecting pipe 31 is roughly disposed in a circle; the connecting pipe 31 is provided with an accommodating groove 310 and a clamping groove 311 that are recessed and extend inward from an outer wall of the connecting pipe 31; and the clamping groove 311 is communicated with the accommodating groove 310. The fixing piece 32 is roughly disposed in an arc; the fixing pieces 32 are accommodated in the accommodating groove 310; the fixing piece 32 is provided with a clamping column 320 that protrudes and extends outward from an upper surface of the fixing piece 32 and several fixing teeth 321 that protrude and extend outward from a lower surface of the fixing piece 32; the clamping column 320 is clamped with the clamping groove 311, so that the fixing piece 32 is clamped with the connecting pipe 31; and the fixing teeth 321 are evenly distributed.

The rotating seat 33 is embedded on an end portion of the connecting pipe 31 and is fixedly connected to the connecting pipe 31 through a screw stem; an abutment surface is disposed on a top surface of the rotating seat 33; a pin-jointed surface pin-jointed to the abutment surface corresponding to the rotating seat 33 is disposed on a bottom surface of a buckling cover 40; and two ends of the mounting rack 10 are respectively clamped to corresponding rotating seats 33 and then are pin-jointed to the corresponding buckling covers 40, to adjust an irradiation angle of the floodlight 100. The rotating seat 33 includes a seat body 330, a central pillar 331 located on a central part of the seat body 330, and several annular abutment teeth 332 disposed on an outer wall of the seat body 330; and an indicator panel 333 located on an end portion of the annular abutment tooth 332. The seat body 330 is provided with a reinforcing ring, and the reinforcing ring is sleeved on the central pillar 331, to reinforce a connection between the seat body 330 and the central pillar 331. The rotating seat 33 passes through the rotating hole 13 through the central pillar 331 and is pin-jointed to the mounting rack 10, so that the rotating seat 33 rotates relative to the mounting rack 10 and can be fastened at any angle.

The annular abutment tooth 332 forms a stepped groove with the seat body 330, so that the annular abutment tooth 332 protrudes outward from the stepped groove. The annular abutment teeth 332 are evenly arranged, and an abutment tooth groove is formed between adjacent annular abutment teeth 332. It can be observed from an outer side and a cross section, that the annular abutment teeth 332 are disposed in a trapezoid shape. In this embodiment, an included angle formed between the adjacent annular abutment teeth 332 and a center axis of the central pillar 331 is an acute angle. Preferably, the included angle formed between the adjacent annular abutment teeth 332 and the center axis of the central pillar 331 is 6°. Understandably, the included angle formed between the adjacent annular abutment teeth 332 and the center axis of the central pillar 331 may alternatively be 5°, 15°, 45°, 60°, or 80°.

Several scale marks are disposed on an outer surface of the indicator panel 333; the scale mark is opposite to the annular abutment tooth and the scale mark and the indicating hole 14 are disposed correspondingly, and the scale marks form a scale mark group that is annularly distributed around the center axis of the central pillar 331, so as to provide reference of a rotation angle of the floodlight 100 for people. In this embodiment, an included angle formed between adjacent scale marks and the center axis of the central pillar 331 is an acute angle. Preferably, the included angle formed between the adjacent scale marks and the center axis of the central pillar 331 is 6°. Understandably, the included angle formed between the adjacent scale marks and the center axis of the central pillar 331 may alternatively be 5°, 15°, 45°, 60°, or 80°.

In this embodiment, the seat body 330, the central pillar 331, the annular abutment teeth 332, and the indicator panel 333 are integrated by using plastic materials.

The buckling cover 40 includes a cover body 41 and an annular clamping tooth 42 extending along an axial direction of the cover body 41, where the cover body 41 is provided with a through hole 410, and several antislip strips 411; and the through hole 410 is adapted to the central pillar 331, so that the buckling cover 40 passes through the through hole 410 through the central pillar 331 and is pin-jointed to the rotating seat 33, so that the buckling cover 40 rotates relative to the rotating seat 33 and can be fastened at any angle. The antislip strips 411 form an antislip strip group that is disposed annularly around a center of the cover body 41, so as to avoid slip when the buckling cover 40 rotates. The annular clamping tooth 42 protrudes outward from an end surface of the cover body 41; the annular clamping tooth 42 is abutted with the abutment tooth groove; annular clamping teeth 42 are evenly arranged; a clamping tooth groove is formed between adjacent annular clamping teeth 42; and the clamping tooth groove is abutted with the annular abutment tooth 332, so that the buckling cover 40 is pin-jointed to the rotating seat 33. In this embodiment, a guide groove 420 is disposed in the annular clamping tooth 42; and an inner wall of the guide groove 420 forms an inclined guide surface extending outward, so as to facilitate installation of the mounting rack 10.

Figure 7:
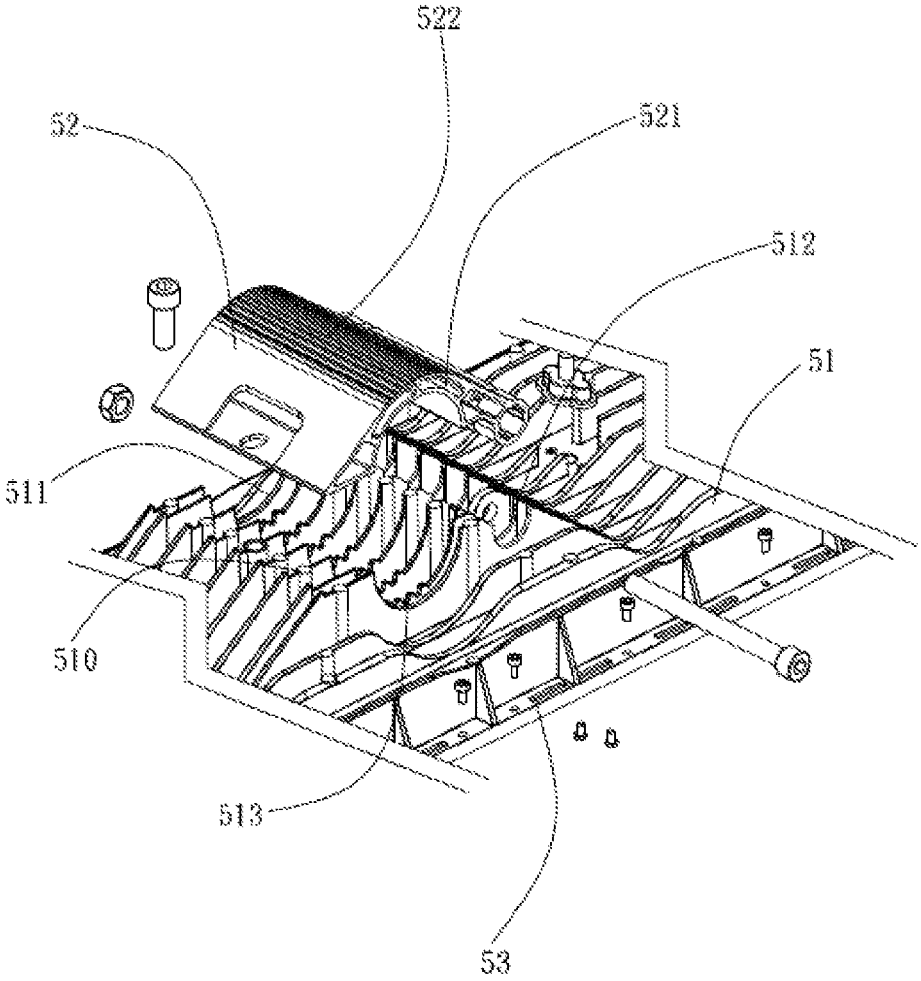
FIG. 7 is an exploded view of a heat dissipation body and a gear cover shown in FIG. 3.
Figure 8:
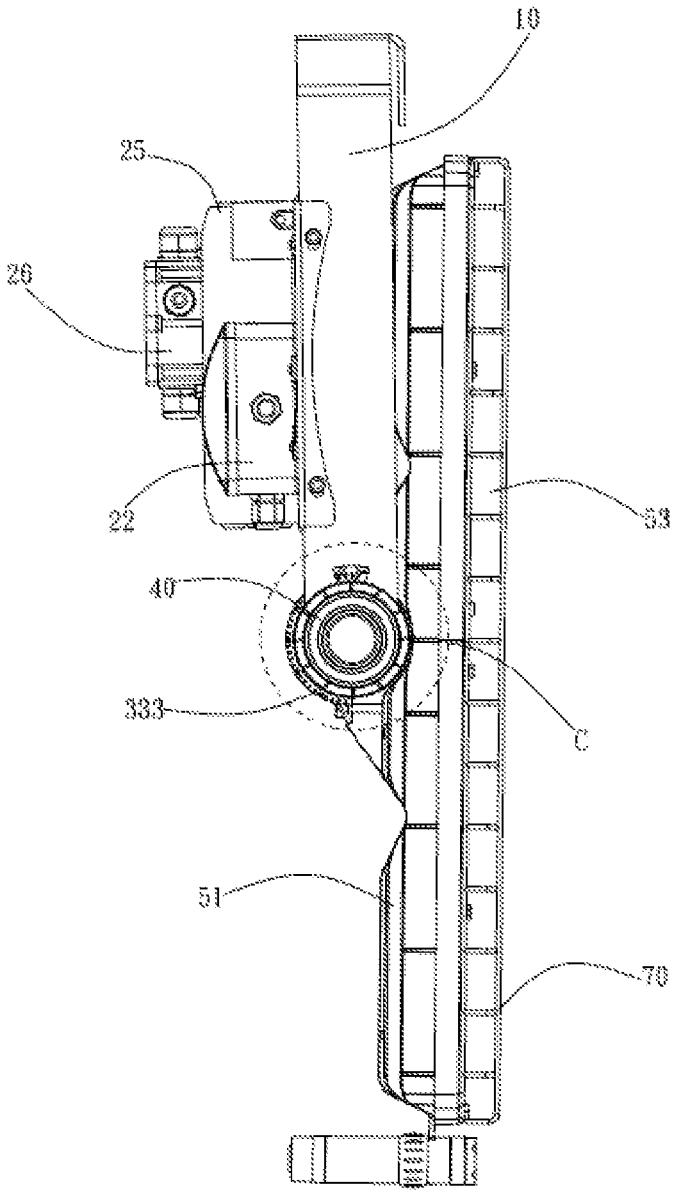
FIG. 8 is a side view of the floodlight shown in FIG. 2.
Figure 9:
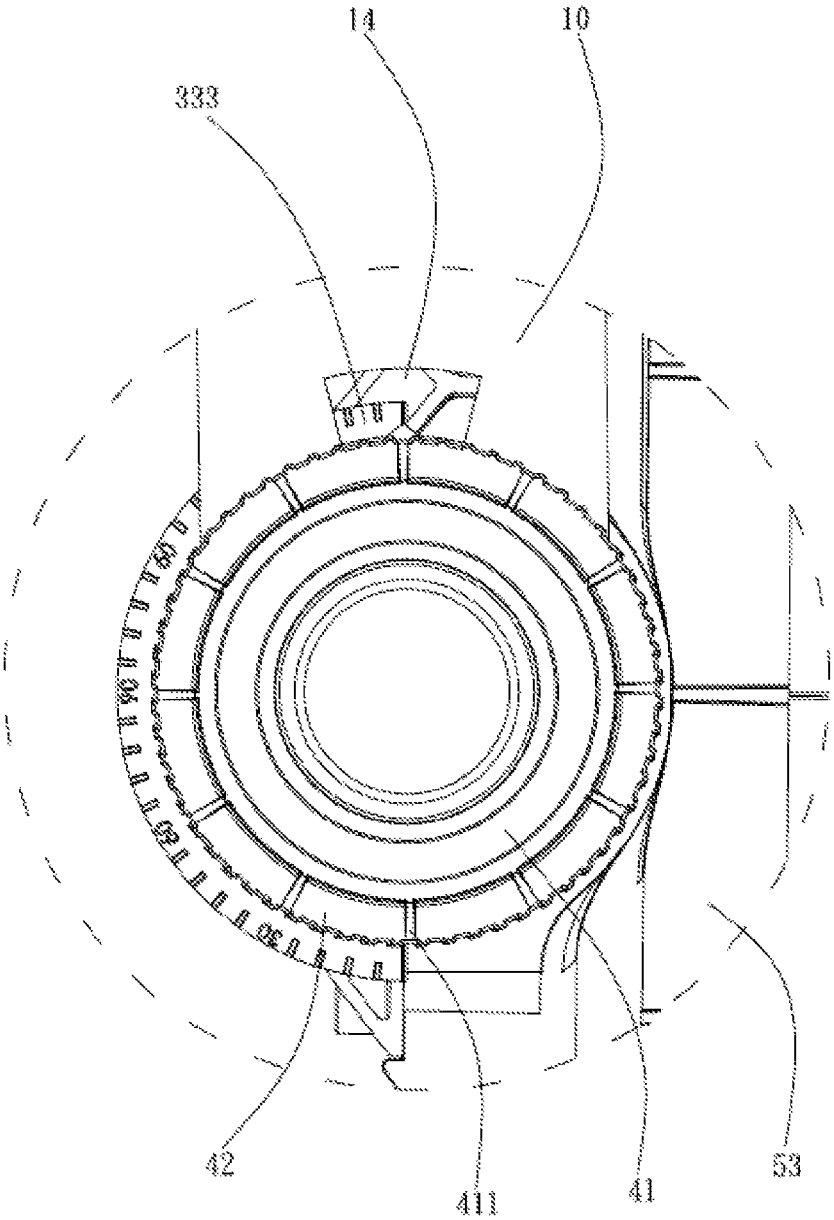
FIG. 9 is an enlarged view of a position C shown in FIG. 8.

Referring to FIG. 7, the heat dissipation component 50 is configured to perform heat dissipation of the LED module 60, where the heat dissipation component 50 includes a heat dissipation body 51, a gear cover 52 installed on the heat dissipation body 51, a connecting piece 53 connected to the heat dissipation body 51, and a surface cover 54 clamped to the connecting piece 53. An accommodating cavity is enclosed by the heat dissipation body 51, the connecting piece 53, and the surface cover 54, for accommodating the LED module 60, and a clamping cavity is enclosed by the gear cover 52 and a top surface of a central part of the heat dissipation body 51, for accommodating the connecting pipe 31.

The heat dissipation body 51 is disposed in an arc, and it can be observed from an outer side and a cross section, that the heat dissipation body 51 is provided with a high central part and two low ends. A first mounting groove 510, a second mounting groove 511, and a third mounting groove 512 are disposed on the central part of the heat dissipation body 51; the second mounting groove 511 is located between the first mounting groove 510 and the third mounting groove 512; the second mounting groove 511 is internally provided with several clamping teeth 513 that are clamped together with the fixing teeth 321 corresponding to the fixing pieces 32; and the heat dissipation body 51 is clamped with the connecting pipe 31 through the fixing piece 32. The heat dissipation body 51 is formed by several heat dissipation fins, where the heat dissipation fins form a heat dissipation fin group extending transversely along an upper surface of the heat dissipation body 51; an end portion of the heat dissipation fin group is clamped inside the connecting piece 53; and a heat dissipation channel is formed between adjacent heat dissipation fins, so that heat of the heat dissipation body 51 can be diffused quickly, avoiding heat concentration and improving heat dissipation efficiency of the heat dissipation body 51. In this embodiment, the heat dissipation body 51 and the connecting piece 53 are integrally fabricated from a heat dissipation material with good heat-conducting performance. Specifically, the heat dissipation material may be an aluminum material or may be a copper material.

The gear cover 52 is configured to fasten the connecting pipe 31. The gear cover 52 is roughly disposed in an arc, an end portion of the gear cover 52 is fastened inside the first mounting groove 510 through a bolt; the other end portion of the gear cover 52 is pin-jointed inside the third mounting groove 512 through a fixing shaft or a bolt, so that the gear cover 52 rotates up and down relative to the heat dissipation body 51. Optionally, the gear cover 52 is provided with several vent holes 521 and heat dissipation strips 522. The vent holes 521 transversely pass through the gear cover 52. The heat dissipation strip 522 extends outward from a top surface of the gear cover 52, and the heat dissipation strips 522 cooperates with the vent holes 521 for heat dissipation of the gear cover 52, to avoid melting at high temperature. In this embodiment, the gear cover 52 is fabricated from a high temperature-resistant material.

The surface cover 54 is clamped with the connecting piece 53; the surface cover 54 is provided with a light outlet 540; the light outlet 540 is located below the LED module 60 and is mounted with a transparent piece 541, so that a light source illuminates outward via the transparent piece 541. Optionally, a silicone ring 542 is sleeved on the transparent piece 541, to prevent water from entering the heat dissipation body 51 from a gap between the transparent piece 541 and the light outlet 540. In this embodiment, the transparent piece 541 is tempered glass. Understandably, the transparent piece 541 may alternatively be a transparent matter, as long as the transparent piece 541 can make the light source illuminate outward.

The LED module 60 includes a circuit board 61 and several LEDs 62 installed on the circuit board 61, where the circuit board 61 is electrically connected to the dimming power source 24, and the LEDs 62 are evenly distributed on the circuit board 61. The circuit board 61 is abutted with a lower surface of the heat dissipation fin group, so that heat of the LEDs 62 is dissipated to outside through the heat dissipation fin group.

The protective cover 70 is formed by several stainless steel tubes. The protective cover 70 covers an outer end surface of the heat dissipation body 51 and is configured to protect the heat dissipation component 50 and the LED module 60.

During installation, first, the LED module 60 including the LEDs 62, the silicone ring 542, the transparent piece 541, and the surface cover 54 are sequentially installed in the accommodating cavity formed by the heat dissipation body 51 and the connecting piece 53; the connecting pipe 31 provided with the fixing pieces 32 is clamped with the heat dissipation body 51; the gear cover 52 covers the connecting pipe 31, so that a plurality of heat dissipation bodies 51 are connected to each other; the rotating seats 33 are installed oppositely on the end portions of the connecting pipe 31 through bolts; and then the two ends of the mounting rack 10 are clamped with the rotating seats 33, so that the buckling cover 40 is pin-jointed to the rotating seat 33 through a fixing shaft or a bolt; the mounting rack 10 is configured to fasten the floodlight 100 according to a direction required for installation. The mounting rack 10 may be installed in a direction of the first installation part 11, or may be installed in a direction of the second mounting part 12, so that the floodlight 100 is applied more flexibly, and has various light irritation angles, to satisfy requirements of different occasions; and finally, the power source module 20 is installed on the mounting rack 10. In the present invention, modular assembly is used, and simple assembly and convenient installation are implemented, so as to resolve a problem that a conventional high-power lamp has a complex structure. By rotating the buckling cover 40, each time positions of an annular clamping tooth 42 and the abutment tooth groove are rotated, fine-tuning on an angle of the floodlight 100 can be performed, thereby avoiding a problem that on-site angular adjustment depends on estimation. In addition, the LED 62 has high efficiency and low energy consumption, thereby achieving resource saving and environmental friendliness.

The foregoing floodlight 100 has a simple structure, modular assembly, easy installation, a small size, long service life, a large illumination range, and an adjustable irradiation angle. The connecting pipe 31 is connected to the heat dissipation body 51 and the gear cover 52 to implement modular assembly of the multiple heat dissipation components 50, so that an overall size of the heat dissipation components 50 is small; the annular clamping tooth 42 paired with the rotating seat 33 is disposed on the gear cover 40, for fixed installation of the mounting rack 10, so that it is very convenient for site operation personnel to adjust an angle of the floodlight 100; and there are multiple installation directions on the mounting rack 10, to satisfy installation requirements of the floodlight 100 in a variety of occasions, thereby making the floodlight 100 have relatively high practicability.

Technical characteristics of the foregoing embodiments may be combined in any manner. For brief description, not all possible combinations of the technical characteristics in the foregoing embodiments are described. However, as long as there is no contradiction in the combinations of these technical characteristics, they should be considered as the scope of this specification.

The foregoing embodiments only provide several implementations of the present invention, and descriptions of the implementations are relatively specific and detailed, but this cannot be understood as restrictions on the scope of the invention patent. It should be pointed that several variations and improvements can be made to the present invention by a person of ordinary skill in the art without departing from the idea of the present invention, and the variations and improvements also fall within the protection scope of the present invention. Therefore, the protection scope of the invention patent shall be subjected to the protection scope of the claims.

What is claimed is:

1. A floodlight, comprising a mounting rack, a power source module installed on the mounting rack, a rotating assembly connected to the mounting rack, two buckling covers that cooperate with two sides of the rotating assembly that are opposite to each other, several heat dissipation components installed on the rotating assembly, and an LED module located inside the heat dissipation component, wherein the rotating assembly comprises a connecting pipe and rotating seats located at two end portions of the connecting pipe; the heat dissipation component comprises a heat dissipation body and a gear cover installed on the heat dissipation body; a clamping cavity is enclosed by a top surface of the heat dissipation body and the gear cover, for accommodating the connecting pipe; an abutment surface is disposed on a top surface of each rotating seat; a pin-jointed surface pin-jointed to each abutment surface corresponding to one of the rotating seats is disposed on a bottom surface of the buckling cover; and two ends of the mounting rack are respectively clamped to corresponding rotating seats and then are pin-jointed to the corresponding buckling covers, to adjust an irradiation angle of the floodlight.

2. The floodlight according to claim 1, wherein the rotating seat comprises a seat body, a central pillar located on a central part of the seat body, and several annular abutment teeth disposed on an outer wall of the seat body; wherein each annular abutment tooth forms a stepped groove with the seat body, so that each annular abutment tooth protrudes outward from the corresponding stepped groove.

3. The floodlight according to claim 2, wherein an abutment tooth groove is formed between adjacent annular abutment teeth, and an included angle formed between the adjacent annular abutment teeth and a center axis of the central pillar is an acute angle.

4. The floodlight according to claim 3, wherein the rotating seat further comprises an indicator panel located at an end portion of at least some of the annular abutment teeth; several scale marks are disposed on an outer surface of the indicator panel; the scale mark is opposite to the corresponding annular abutment teeth; and the scale marks form a scale mark group that is annularly distributed around the center axis of the central pillar.

5. The floodlight according to claim 4, wherein the rotating assembly further comprises several fixing pieces installed below the connecting pipe; the connecting pipe is provided with an accommodating groove and a clamping groove that are recessed and extend inward from an outer wall of the connecting pipe; the fixing pieces are accommodated in the accommodating groove; the fixing piece is provided with a clamping column that protrudes and extends outward from an upper surface of the fixing piece and several fixing teeth that protrude and extend outward from a lower surface of the fixing piece; and the clamping column is clamped with the clamping groove, so that the fixing piece is clamped with the connecting pipe.

6. The floodlight according to claim 5, wherein a first mounting groove, a second mounting groove, and a third mounting groove are disposed on the heat dissipation body; the second mounting groove is located between the first mounting groove and the third mounting groove; the second mounting groove is provided with several clamping teeth that are clamped together with the fixing teeth corresponding to the fixing pieces; and the heat dissipation body is clamped with the connecting pipe through the fixing piece.

7. The floodlight according to claim 2, wherein the rotating assembly further comprises several fixing pieces installed below the connecting pipe; the connecting pipe is provided with an accommodating groove and a clamping groove that are recessed and extend inward from an outer wall of the connecting pipe; the fixing pieces are accommodated in the accommodating groove; the fixing piece is provided with a clamping column that protrudes and extends outward from an upper surface of the fixing piece and several fixing teeth that protrude and extend outward from a lower surface of the fixing piece; and the clamping column is clamped with the clamping groove, so that the fixing piece is clamped with the connecting pipe.

8. The floodlight according to claim 7 wherein a first mounting groove, a second mounting groove, and a third mounting groove are disposed on the heat dissipation body; the second mounting groove is located between the first mounting groove and the third mounting groove; the second mounting groove is provided with several clamping teeth that are clamped together with the fixing teeth corresponding to the fixing pieces; and the heat dissipation body is clamped with the connecting pipe through the fixing piece.

9. The floodlight according to claim 3, wherein the rotating assembly further comprises several fixing pieces installed below the connecting pipe; the connecting pipe is provided with an accommodating groove and a clamping groove that are recessed and extend inward from an outer wall of the connecting pipe; the fixing pieces are accommodated in the accommodating groove; the fixing piece is provided with a clamping column that protrudes and extends outward from an upper surface of the fixing piece and several fixing teeth that protrude and extend outward from a lower surface of the fixing piece; and the clamping column is clamped with the clamping groove, so that the fixing piece is clamped with the connecting pipe.

10. The floodlight according to claim 9, wherein a first mounting groove and a second mounting groove, and a third mounting groove are disposed on the heat dissipation body; the second mounting groove is located between the first mounting groove and the third mounting groove; and the second mounting groove is provided with several clamping teeth that are clamped together with the fixing teeth corresponding to the fixing pieces; and the heat dissipation body is clamped with the connecting pipe through the fixing piece.

11. The floodlight according to claim 3, wherein the buckling cover comprises a cover body and an annular clamping tooth extending along an axial direction of the cover body; the annular clamping tooth is abutted with the abutment tooth groove; the annular clamping teeth are evenly arranged, and a clamping tooth groove is formed between adjacent annular clamping teeth; and the clamping tooth groove is abutted with the annular abutment tooth.

12. The floodlight according to claim 11, wherein the rotating assembly further comprises several fixing pieces installed below the connecting pipe; the connecting pipe is provided with an accommodating groove and a clamping groove that are recessed and extend inward from an outer wall of the connecting pipe; the fixing pieces are accommodated in the accommodating groove; the fixing piece is provided with a clamping column that protrudes and extends outward from an upper surface of the fixing piece and several fixing teeth that protrude and extend outward from a lower surface of the fixing piece; and the clamping column is clamped with the clamping groove, so that the fixing piece is clamped with the connecting pipe.

13. The floodlight according to claim 12, wherein a first mounting groove, a second mounting groove, and a third mounting groove are disposed on the heat dissipation body; the second mounting groove is located between the first mounting groove and the third mounting groove; the second mounting groove is provided with several clamping teeth that are clamped together with the fixing teeth corresponding to the fixing pieces; and the heat dissipation body is clamped with the connecting pipe through the fixing piece.

14. The floodlight according to claim 11, wherein the annular clamping tooth protrudes outward from an end surface of the cover body; a guide groove is disposed in the annular clamping tooth; and an inner wall of the guide groove forms an inclined guide surface extending outward.

15. The floodlight according to claim 14, wherein the rotating assembly further comprises several fixing pieces installed below the connecting pipe; the connecting pipe is provided with an accommodating groove and a clamping groove that are recessed and extend inward from an outer wall of the connecting pipe; the fixing pieces are accommodated in the accommodating groove; the fixing piece is provided with a clamping column that protrudes and extends outward from an upper surface of the fixing piece and several fixing teeth that protrude and extend outward from a lower surface of the fixing piece; and the clamping column is clamped with the clamping groove, so that the fixing piece is clamped with the connecting pipe.

16. The floodlight according to claim 15, wherein a first mounting groove, a second mounting groove, and a third mounting groove are disposed on the heat dissipation body; the second mounting groove is located between the first mounting groove and the third mounting groove; the second mounting groove is provided with several clamping teeth that are clamped together with the fixing teeth corresponding to the fixing pieces; and the heat dissipation body is clamped with the connecting pipe through the fixing piece.

17. The floodlight according to claim 14, wherein the rotating assembly further comprises several fixing pieces installed below the connecting pipe; the connecting pipe is provided with an accommodating groove and a clamping groove that are recessed and extend inward from an outer wall of the connecting pipe; the fixing pieces are accommodated in the accommodating groove; the fixing piece is provided with a clamping column that protrudes and extends outward from an upper surface of the fixing piece and several fixing teeth that protrude and extend outward from a lower surface of the fixing piece; and the clamping column is clamped with the clamping groove, so that the fixing piece is clamped with the connecting pipe.

18. The floodlight according to claim 17, wherein a first mounting groove and a second mounting groove, and a third mounting groove are disposed on the heat dissipation body; the second mounting groove is located between the first mounting groove and the third mounting groove; and the second mounting groove is provided with several clamping teeth that are clamped together with the fixing teeth corresponding to the fixing pieces; and the heat dissipation body is clamped with the connecting pipe through the fixing piece.

19. The floodlight according to claim 18, wherein one end of the gear cover is fastened to the first mounting groove through a bolt, and the other end of the gear cover is pin-jointed in the third mounting groove through a fixing shaft, so that the gear cover rotates up and down relative to the heat dissipation body.

20. A floodlight, comprising a mounting rack, a power source module installed on the mounting rack, a rotating assembly connected to the mounting rack, two buckling covers that cooperate with two sides of the rotating assembly that are opposite to each other, several heat dissipation components installed on the rotating assembly, and an LED module located inside the heat dissipation component, wherein the rotating assembly comprises a connecting pipe and rotating seats located at two end portions of the connecting pipe; the heat dissipation component comprises a heat dissipation body and a gear cover installed on the heat dissipation body; a clamping cavity is enclosed by a top surface of the heat dissipation body and the gear cover, for accommodating the connecting pipe; several annular abutment teeth are disposed on an outer wall of each rotating seat; an annular clamping tooth engaged with at least one of the annular abutment teeth corresponding to each rotating seat is disposed on a bottom surface of the buckling cover; and two ends of the mounting rack are respectively clamped to corresponding rotating seats and then are pin-jointed to the corresponding buckling covers, to adjust an irradiation angle of the floodlight.

* * * * *